US006492892B1

(12) United States Patent
Brennan et al.

(10) Patent No.: US 6,492,892 B1
(45) Date of Patent: Dec. 10, 2002

(54) MAGNET WIRE HAVING DIFFERENTIAL BUILD INSULATION

(75) Inventors: Thomas W. Brennan, Jefferson City; Norris L. Hill, New Bloomfield, both of MO (US); Hoan Duy Le, Cary, NC (US); Thomas L. Linsenbardt, Lohman, MO (US)

(73) Assignee: ABB Inc., Raleigh, NC (US)

( * ) Notice: Subject to any disclaimer, the term of this patent is extended or adjusted under 35 U.S.C. 154(b) by 434 days.

(21) Appl. No.: 09/054,947

(22) Filed: Apr. 3, 1998

(51) Int. Cl.[7] ..... H01F 27/30
(52) U.S. Cl. ..... 336/206; 336/223; 336/205
(58) Field of Search ..... 336/205, 206, 336/223

(56) References Cited

U.S. PATENT DOCUMENTS

| | | | | |
|---|---|---|---|---|
| 2,307,588 A | * | 1/1943 | Jackson et al. | 336/205 |
| 2,949,593 A | | 8/1960 | Staley et al. | 336/186 |
| 3,153,212 A | | 10/1964 | Davis | 336/149 |
| 3,427,578 A | * | 2/1969 | Gray et al. | 336/206 |
| 3,504,104 A | | 3/1970 | Suzuki | 174/120 |
| 3,648,207 A | * | 3/1972 | Caltagirone | 336/206 |
| 3,860,744 A | | 1/1975 | Schuler | 174/117 |
| 3,891,955 A | | 6/1975 | Horton, III | 336/205 |
| 4,204,087 A | | 5/1980 | Lin et al. | 174/120 |
| 4,406,056 A | | 9/1983 | Buckley et al. | 29/605 |
| 4,412,094 A | | 10/1983 | Dougherty et al. | 174/110 |
| 4,503,605 A | | 3/1985 | Buckley | 29/605 |
| 4,554,730 A | | 11/1985 | Westervelt et al. | 29/605 |
| 4,818,909 A | | 4/1989 | Balke | 310/208 |
| 5,428,337 A | | 6/1995 | Vinclarelli et al. | 336/223 |
| 5,504,469 A | | 4/1996 | McGrane | 336/206 |

OTHER PUBLICATIONS

U.S. patent application Ser. No. 08/907,657, Brennan et al., filed Aug. 8, 1997.
U.S. patent application Ser. No. 08/905,424, Hill et al., filed Aug. 4, 1997.

* cited by examiner

*Primary Examiner*—Anh Mai

(57) ABSTRACT

A magnet wire having differential build insulation for use in transformer coils is disclosed. The wire has a rectangular conductor with an insulation that is thicker on the top and bottom surfaces of the wire than it is on the sides. With the thicker coating on the top and bottom, the wire can be used in layer wound distribution transformer coils, both high voltage wire wound coils and low voltage wound coils, without needing additional insulation between the layers of the winding.

6 Claims, 2 Drawing Sheets

FIG. 4

MAGNET WIRE HAVING DIFFERENTIAL BUILD INSULATION

CROSS REFERENCE TO RELATED APPLICATIONS

Application Ser. No. 08/905,424 filed Aug. 4, 1997 by Norris L. Hill and Thomas L. Linsenbardt entitled METHOD AND APPARATUS FOR MANUFACTURING A VARIABLE INSULATED HELICALLY WOUND ELECTRICAL COIL, and application Ser. No. 08/907,657 filed Aug. 8, 1997 by Thomas W. Brennan, Norris L. Hill, Thomas J. Lanoue, Hoan Duy Le and Thomas L. Linsenbardt entitled CELLULOSE-FREE TRANSFORMER, both assigned to the same assignee as the present application.

BACKGROUND OF THE INVENTION

1. Field of the Invention

This invention relates to an insulated magnet wire for use in a layer wound distribution transformer coil, and more specifically to a new and improved magnet wire having differential build insulation.

2. Description of the Prior Art

In many conventional windings, such as transformer windings, a wire winding for a high voltage section typically uses rectangular wire which has an enamel or polymer insulation on it for turn-to-turn insulation and utilizes paper or other layers of sheet material insulation between layers of turns of the coil to provide adequate insulation between the helically wound layers of insulated wire. The layer insulation is generally constructed from sheet material which is a uniform thickness in a width slightly greater than the width of the wire layers. It is wound into the coil as the coil is wound. After each layer the wire has been helically wound onto the coil, one or more turns of the full width layer insulation is wound onto the layer after which the next layer of wire is wound onto the coil. This process repeats through the entire coil. With conventionally wound coils, the layer insulation between layers must be thick enough to withstand the highest voltage difference between the layers. Since the windings are continuous and helically wound, the voltage between the layers varies along the coil axis or width, with the greatest voltage difference occurring between layers occurring between the starting end of a lower layer and the finish end of the layer above it. There is almost no voltage difference between the two layers on the opposite sides of the coil. The thickness of the full width layer insulation must be such that it provides the necessary dielectric strength on the start finish/side where the voltage difference between the layers is the highest. Over the remainder of the layer, the layer insulation is thicker than required.

One method of eliminating the need for the additional layer of sheet insulation between adjacent layers of the coil is disclosed in the aforesaid related applications Ser. No. 905,424 and Ser. No. 907,657,now abandoned the disclosures of which are incorporated herein by this reference thereto. In those applications the method of manufacturing the variably insulated helically wound electrical transformer coil involved integrating the insulating of the conductor into the winding process and requires a complex winding machine. The additional insulation was added to the wire in those areas of the coil where the additional dielectric strength was needed. Thereafter during the winding of the cured insulated wire into the coil of predetermined shape, the portions of the wire having additional insulation were located in the areas of the coil where the greatest dielectric strength is needed. While this method is satisfactory, it requires a complex winding machine and does prevent a supply coil of the insulated wire being prepared in advance for subsequent use in winding coils for any transformer of different sizes It would be desirable to provide an insulated magnet wire for use in a layer wound distribution transformer coil wherein the rectangular conductor is provided with an insulation that is thicker on the top and bottom surfaces of the conductor than on the sides so that the need for additional insulation between the layers of the winding is eliminated and the same insulated magnet wire can be used in layer wound distribution transformer coils of different sizes and wound with a conventional winding machine.

SUMMARY OF THE INVENTION

The present invention relates to an insulated magnet wire for use in a layer wound distribution transformer coil which eliminates the need for a separate layer of insulation between the layers of the coil. An insulated magnet wire in accordance with the present invention includes a rectangular conductor having an insulation coating on the top and bottom and both sides of the conductor. The coating on the top and bottom of the conductor is thicker than the coating on sides of the conductor so that when the insulated conductor is wound in layers in the distribution coil, the thickness of insulation between adjacent layers in the transformer coil is greater than the insulation between adjacent turns in the coil.

Further in accordance with the invention there is provided a layer wound distribution transformer coil having multiple coil layers. Each coil layer includes multiple turns of wire, the wire having a rectangular conductor having an insulation coating on the top and bottom and both sides of the conductor. The coating on the top and bottom of the conductor is thicker than the coating on the sides of the conductor so that when the insulated conductor is wound in layers in the distribution transformer coil, the thickness of insulation between adjacent layers in the transformer coil is greater than the insulation between adjacent turns in the coil.

BRIEF DESCRIPTION OF THE DRAWINGS

Referring to FIG. 1 there is illustrated a typical distribution transformer coil 10 for use in an oil-filled transformer. These coils are wound with a high voltage primary winding and a low voltage secondary winding. The high voltage end and leads and the low voltage end and leads are indicated in FIG. 1. A rectangular cellulose-free transformer coil of this type is described and illustrated in the aforesaid copending application Ser. No. 907,657.

In conventional distribution transformers, the high voltage windings are often wound using aluminum or copper rectangular cross section wire. The wire is usually insulated with a thin solid film of insulation that may be FORMVAR® (polyvinyl formal enamel) RADEL R® (polyphenylsulfone resin) or other suitable insulating material which is of uniform thickness around the perimeter of the wire. The thickness of the insulation is that which is required to withstand the turn-to-turn voltage difference between adjacent turns of wire in the winding. The thickness of this insulation is typically 0.001 to 0.002" for FORMVAR® and up to 0.004" for RADEL R®.

Since the wire of the high voltage winding and in many cases wire in strap-wound low-voltage windings is wound helically in alternating layers, the start turn of one layer lies radially under the finish turn of the layer that is wound on top of it. The voltage difference between the start turn of the lower layer and the finish turn of the layer above it is much higher than the turn-to-turn voltage difference. In fact, the voltage difference between the start and finish turns is twice the number of turns per layer greater than the turn-to-turn voltage, if the layers have equal numbers of turns. Because of this high layer to layer voltage difference, the wire insulation by itself is not usually enough to withstand the layer-to-layer voltage difference and layers of sheet insulation material are generally wound into the coil between the layers to withstand the voltage difference. A cross-section of this prior art construction is shown in FIG. 2 for two layers of a coil.

Figure 1:
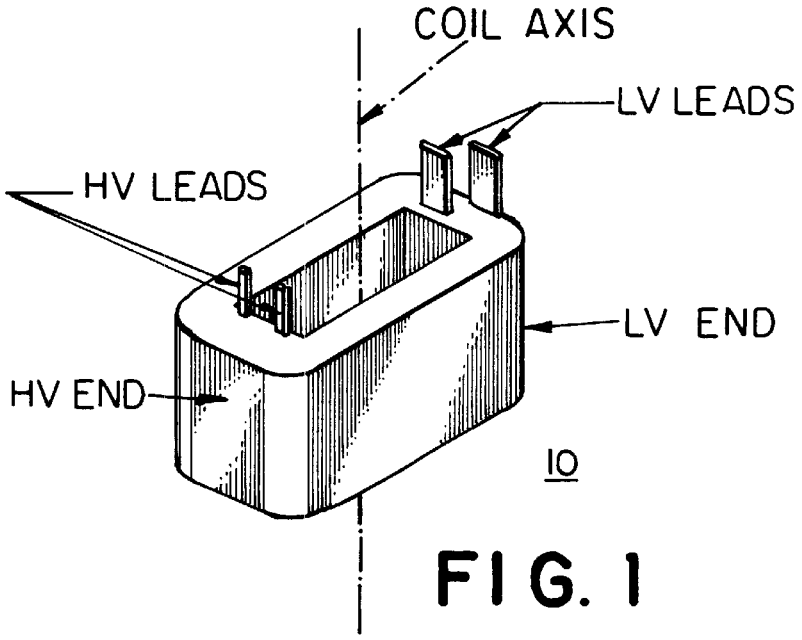
FIG. 1 is a perspective view of the typical distribution transformer coil for employing the present invention.
Figure 2:
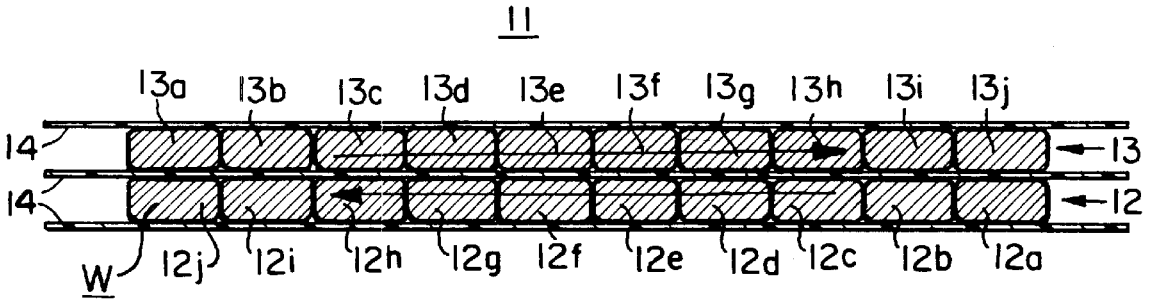
FIG. 2 PRIOR ART
FIG. 2 is a partial sectional view of two layers of a conventional helically wound winding of the prior art.

Referring to FIG. 2 there is illustrated a partial sectional view of a prior art helically wound high voltage coil 11 including two coil layers 12 and 13. The coil layers 12*a*–12*j* and 13*a*–13*j* are wound in the directions of the arrows with the direction reversing for each coil layer. While only two coil layers have been illustrated, it is to be understood that additional coil layers will be utilized in a conventional transformer. A wire winding of the prior art typically utilizes rectangular wire W which has an insulation such as an enamel or polymer (now shown) on it for turn-to-turn insulation and utilizes paper insulation 14 between layers of turns in the coil to provide adequate insulation between the helically wound layers of insulated wire. The layer insulation 14 is generally constructed from sheet material which has a uniform thickness and a width slightly greater than the width of the coil layers. It is wound into the coil as the coil is wound. After each layer wire has been helically wound onto the coil, one or more turns of the full width layer insulation is wound onto the layer after which the next layer of wire is wound onto the coil. This process repeats through the entire coil. The layer insulation between layers must be thick enough to withstand the highest voltage difference between the layers. Since the windings are continuous and helically wound, the voltage between the layers varies along the coil axis, with the greatest voltage difference between layers occurring between the starting end 12*a*, of a lower layer and a finish end 13*j*, of the layer above it.

Figure 3:
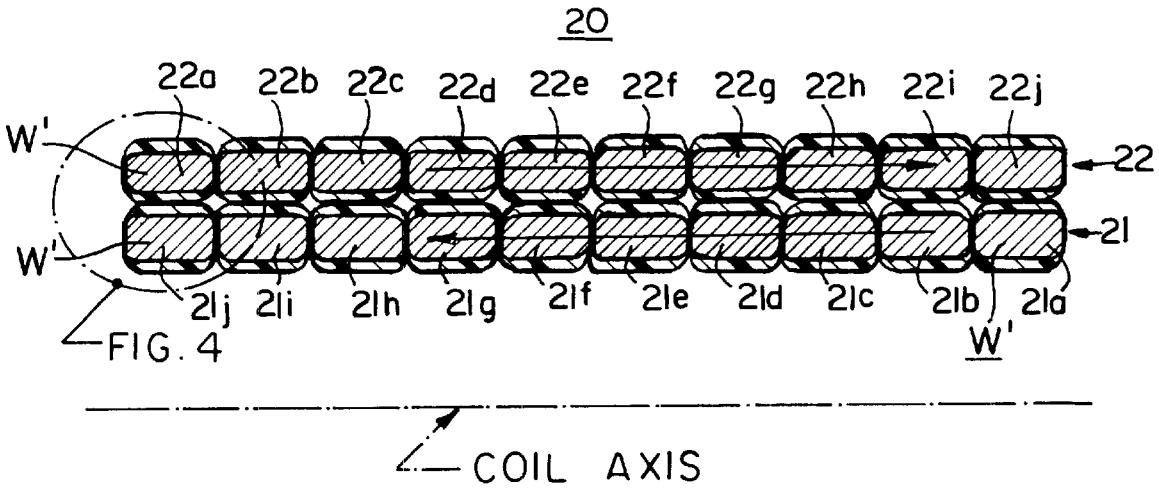
FIG. 3 is a partial sectional view of two layers of a helically wound wire coil embodying the present invention.
Figure 4:
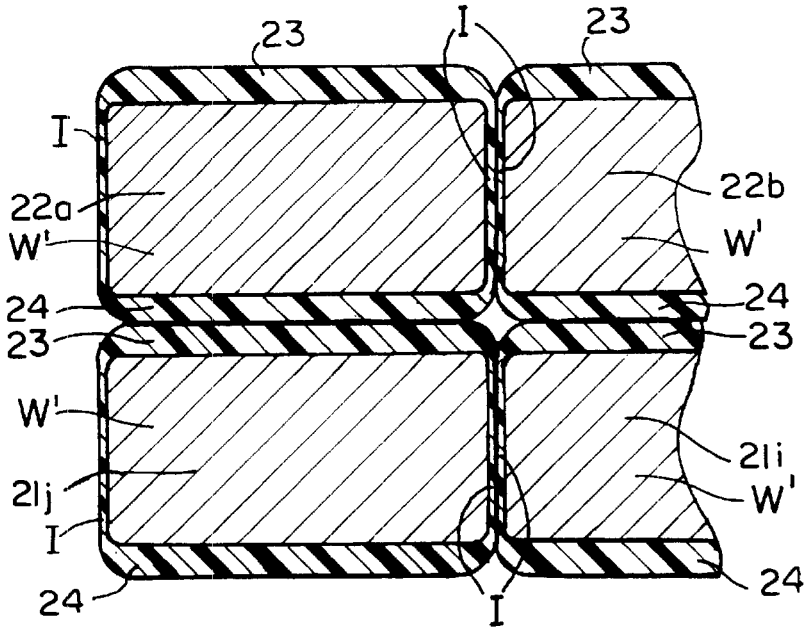
FIG. 4 is an enlarged cross sectional view of the wire conductors in the area in FIG. 3 indicated at FIG. 4 to which the maximum added insulation has been applied.

Referring to FIGS. 3 and 4 it will be seen that the wire produced having the differential build insulation in accordance with the present invention does not have a uniform coating of insulation. As may be seen in FIG. 3, there is illustrated a partial sectional view of a helically wound high voltage coil 20 including two coil layers 21 and 22. The coil layers 21*a*–21*j* and 22*a*–22*j* are wound in the direction of the arrows with the direction reversing for each coil layer. The starting wire W' used for making this coil 20 is a bare wire to the surfaces of which is added an insulation such as an enamel or polymer. As best seen in FIG. 4, this insulation completely surrounds all external surfaces of the rectangular wire W'. The insulation coating I on the sides of the wire W' has a normal thickness of about 0.001" to about 0.004" to withstand turn-to-turn voltage differences and is thicker on the top and bottom to withstand the higher layer to layer voltage differences. The thickness of the insulation 23 on the top of the wire W' and the thickness of the insulation 24 on the bottom of the wire W' will vary from about 0.006" up to about 0.015" depending on the electrical requirements of the coil it will be used in. Differential insulation build as disclosed in FIGS. 3 and 4 according to the present invention can be produced on the wire by appropriately designed dies in coating methods such as extrusion coating or film coating. When wire with differential build insulation is used in a helically wound layer winding, the greater build of insulation on the top and bottom surfaces of the wire will serve the purpose of the layer insulation allowing elimination of the layer insulation disclosed in connection with FIG. 2. A cross-section of two layers of a coil 20 wound using the differential build insulation in accordance with the present invention is shown in FIGS. 3 and 4.

The advantage of using a conductor or wire coated with differential build insulation according to the present invention allows transformer coils to be wound without the layer insulation of the prior art thus removing one part from the coil bill of materials eliminating its associated inventory costs, handling costs and installation time. The magnet wire having a differential build insulation according to the present invention does not require additional processing or adding of materials prior to, or during, the coil winding process in order to increase its layer-to-layer dielectric strength. It can be produced in substantial quantities prior to winding of coils and does not require a selective addition of insulation during the winding process as required in the high voltage coils of the aforesaid related applications.

It should be understood the invention is not limited to the specific arrangements shown and that further modifications may be made without departing from the spirit and scope of the invention as set forth in the appended claims.

What is claimed is:

1. An insulated magnet wire for use in a layer wound distribution transformer coil comprising a rectangular conductor having an insulation coating on the top and bottom and both sides of said conductor, said coating on said top and bottom of said conductor being thicker than the coating on the sides of said conductor so that when the insulated conductor is wound in layers in a distribution transformer coil the thickness of insulation between adjacent layers in the transformer coil is greater than the insulation between adjacent turns in the coil.

2. An insulated magnet wire according to claim 1 wherein said insulation coating on said conductor is a resin insulation.

3. An insulated magnet wire according to claim 1 wherein said insulation coating on said conductor is an enamel insulation.

4. An insulated magnet wire according to claim 1 wherein said insulation coating on said top and bottom of said conductor has a thickness within the range from about 0.006" up to about 0.015".

5. An insulated magnet wire according to claim 4 wherein said insulation coating on the sides of said conductor has a thickness of about 0.001" to about 0.004".

6. A layer wound distribution transformer coil comprising multiple coil layers, each coil layer comprising multiple turns of wire, said wire comprising a rectangular conductor having an insulation coating on the top and bottom and both sides of said conductor, said coating on said top and bottom of said conductor being thicker than the coating on the sides of said conductor so that when the insulated conductor is wound in layers in the distribution transformer coil, the thickness of insulation between adjacent layers in the transformer coil is greater than the insulation between adjacent turns in the coil.

* * * * *